US010940356B2

(12) United States Patent
Anderson et al.

(10) Patent No.: US 10,940,356 B2
(45) Date of Patent: Mar. 9, 2021

(54) ROTATING CONNECTION EXERCISE APPARATUS

(71) Applicants: Jerrod Daniel Anderson, Allen, TX (US); Clinton Robert Anderson, Tulsa, OK (US)

(72) Inventors: Jerrod Daniel Anderson, Allen, TX (US); Clinton Robert Anderson, Tulsa, OK (US)

( * ) Notice: Subject to any disclaimer, the term of this patent is extended or adjusted under 35 U.S.C. 154(b) by 80 days.

(21) Appl. No.: 16/189,453

(22) Filed: Nov. 13, 2018

(65) Prior Publication Data

US 2019/0290953 A1 Sep. 26, 2019

Related U.S. Application Data

(60) Provisional application No. 62/674,361, filed on May 21, 2018, provisional application No. 62/557,437, filed on Sep. 12, 2017.

(51) Int. Cl.

| | |
|---|---|
| ***A63B 21/072*** | (2006.01) |
| ***A63B 21/00*** | (2006.01) |
| ***B25G 3/20*** | (2006.01) |
| ***A63B 21/075*** | (2006.01) |

(52) U.S. Cl.

CPC ..... *A63B 21/072* (2013.01); *A63B 21/075* (2013.01); *A63B 21/4035* (2015.10); *A63B 21/4047* (2015.10); *A63B 21/4049* (2015.10); *B25G 3/20* (2013.01)

(58) Field of Classification Search

CPC ..... Y10T 403/39; Y10T 403/7182; Y10T 403/7188; Y10T 403/7194; F16B 7/0493; F16B 7/185; E04F 11/1834; B25G 3/20; A63B 21/072–08; A63B 21/075; A63B 21/4035; A63B 21/4049; A63B 69/004; A63B 2069/0042; A63B 21/4047

See application file for complete search history.

(56) References Cited

U.S. PATENT DOCUMENTS

| | | | | | |
|---|---|---|---|---|---|
| 3,495,857 | A * | 2/1970 | Hawke | F16B 5/0225 | 403/57 |
| 4,566,819 | A * | 1/1986 | Johnston | E04G 7/14 | 403/385 |
| 4,624,374 | A * | 11/1986 | Murtaugh | B63B 17/04 | 211/182 |
| 4,784,385 | A * | 11/1988 | D'Angelo | A63B 21/0084 | 482/111 |
| 4,900,183 | A * | 2/1990 | Souchko | A63H 33/106 | 403/385 |
| 4,913,419 | A * | 4/1990 | McAuliffe | A63B 69/004 | 482/87 |

(Continued)

*Primary Examiner* — Nyca T Nguyen

(57) ABSTRACT

In one embodiment, an apparatus may include a first receiver and a second receiver, wherein the first receiver's first end is substantially cylindrical and wherein the first receiver's second end includes a first clamp, wherein the second receiver's first end is substantially cylindrical and wherein the second receiver's second end includes a second clamp, wherein the first receiver and the second receiver are detachably attached to one another via one or more first securing objects positioned on the first clamp and on the second clamp, and wherein at least one tightening clamp resides on the first receiver's first end and on the second receiver's first end.

13 Claims, 8 Drawing Sheets

(56) References Cited

U.S. PATENT DOCUMENTS 5,013,034 A * 5/1991 March ..... A63B 21/015 482/115
5,312,308 A * 5/1994 Hamilton ..... A63B 21/072 482/44
5,443,232 A * 8/1995 Kesinger ..... H02G 3/263 248/62
6,283,425 B1 * 9/2001 Liljevik ..... H01Q 1/125 248/218.4
6,478,500 B1 * 11/2002 Farenholtz ..... A47F 8/00 223/66
6,786,302 B2 * 9/2004 Liew ..... E04G 7/14 182/186.8
7,086,997 B1 * 8/2006 Fields ..... A63B 69/004 482/83
7,377,883 B1 * 5/2008 Blanton ..... A63B 21/00192 273/456
7,883,452 B1 2/2011 Chen
8,267,841 B1 9/2012 Allison et al.
8,974,354 B1 * 3/2015 Nelson ..... A63B 21/16 482/94
9,574,384 B1 * 2/2017 Reischmann ..... E05D 11/10
2004/0063553 A1 4/2004 Viscount
2004/0081510 A1 * 4/2004 Zheng ..... A47C 4/286 403/188
2004/0245513 A1 * 12/2004 Izumi ..... E04F 11/1834 256/65.02
2007/0135273 A1 * 6/2007 Ljevaja ..... A63B 15/00 482/108
2007/0265146 A1 * 11/2007 Kowalczewski ... G06F 19/3481 482/92
2008/0234112 A1 * 9/2008 Hernandez ..... A63B 21/012 482/63
2010/0004106 A1 * 1/2010 Scheiman ..... A63B 21/4035 482/139
2011/0173778 A1 7/2011 Wales
2012/0252641 A1 10/2012 Odneal et al.
2013/0059699 A1 * 3/2013 Brenner ..... A63B 69/004 482/83
2013/0210589 A1 8/2013 Thompson et al.
2014/0199112 A1 * 7/2014 Milner ..... E04F 11/1834 403/72
2015/0174445 A1 6/2015 Robertson, Jr.
2015/0297942 A1 * 10/2015 Tully ..... A63B 21/16 482/94
2016/0144219 A1 5/2016 Koenig
2016/0256720 A1 * 9/2016 Grant ..... A63B 21/1636
2017/0007872 A1 * 1/2017 Ho ..... A63B 21/028
2017/0106525 A1 * 4/2017 Brauer ..... B25F 5/026
2017/0136330 A1 * 5/2017 Stevens ..... A63B 69/004
2017/0189732 A1 * 7/2017 Lee ..... A63B 21/008
2017/0205024 A1 * 7/2017 Hennessey ..... F16M 11/16
2017/0356178 A1 * 12/2017 Corbett ..... F16B 7/0446

* cited by examiner

200

300

400

500

600

ROTATING CONNECTION EXERCISE APPARATUS

TECHNICAL FIELD

This application generally relates to weightlifting equipment and more specifically relates to apparatus that allow users to effectively perform resistance training. These pieces of equipment were designed to provide a better, more efficient, and more effective workout than what other pieces of equipment offer providing a full body or specific specialized isolated workout to the user depending on the way they are utilized and setup. Any major muscle group can be strengthened with the use of these devices and they may be used by general fitness users, bodybuilders, strength athletes, powerlifters, and/or any and all competitive sport athletes.

BACKGROUND

In the market today, there exists may pieces of training and weightlifting equipment. There has always been a distinct separation between the weight room and the playing field. It is advisable that athletes are trained according to the demands of their particular sport rather than for pure strength. The idea is 'functional' strength relative to the sport the athlete is competing in. The movement patterns and requirements of an offensive lineman, specifically, require a different training regime and different pieces of equipment than a baseball or basketball player. With the current examples, it is desirable to close the gap between the weight room and the playing field providing strength training equipment that mimic and provide more specific movement patterns related to the athletes' sport.

SUMMARY

In one embodiment, an apparatus may include a first receiver and a second receiver, wherein the first receiver's first end is substantially cylindrical and wherein the first receiver's second end includes a first clamp, wherein the second receiver's first end is substantially cylindrical and wherein the second receiver's second end includes a second clamp, wherein the first receiver and the second receiver are detachably attached to one another via one or more first securing objects positioned on the first clamp and on the second clamp, and wherein at least one tightening clamp resides on the first receiver's first end and on the second receiver's first end.

In another example embodiment, an apparatus may include a first receiver and a second receiver, wherein the first receiver's first end is substantially cylindrical and wherein the first receiver's second end includes a first clamp, wherein the second receiver's first end is substantially cylindrical and wherein the second receiver's second end includes a second clamp, wherein the first receiver and the second receiver are detachably attached to one another via one or more first securing objects positioned on the first clamp and on the second clamp, wherein at least one tightening clamp resides on the first receiver's first end and on the second receiver's first end, and wherein the first receiver is configured move between around 0 degrees and to around 180 degrees when connected to the second receiver.

In another example embodiment, an apparatus may include a first receiver and a second receiver, wherein the first receiver's first end is substantially cylindrical and wherein the first receiver's second end includes a first clamp, wherein the second receiver's first end is substantially cylindrical and wherein the second receiver's second end includes a second clamp, wherein the first receiver and the second receiver are detachably attached to one another via one or more first securing objects positioned on the first clamp and on the second clamp, wherein at least one tightening clamp resides on the first receiver's first end and on the second receiver's first end, and wherein the one or more second securing objects is at least one of: removable, non-removable, a screw clamp, a pin, a hinge clamp, a clip, and a collar.

BRIEF DESCRIPTION OF THE DRAWINGS

The novel features believed to be characteristic of this apparatus are set forth with particularity in the appended claims. The apparatus itself, however, both as to its organization and method of operation, together with further objects and advantages thereof, may best be understood by reference to the following description taken in connection with the accompanying drawings in which:

DETAILED DESCRIPTION

In the current weightlifting environment, numerous weight rooms contain multiple "Jammer," or other type of strength training machines, that take up massive amounts of space and can be extremely expensive to obtain. "Jammer" machines, for instance, have two handles that the athlete grabs onto and in a standing athletic position will thrust the handles forward with arms straight out. This machine is on a fixed track, not dynamic in movement, and maintains a large footprint where positioned. In one embodiment, the current device is designed to fit onto the end of a barbell, or other type of cylindrical bar, that provides a more robust workout for the user due to the dynamic and unrestrained nature of the barbell in its pivot (landmine, sledmine, or against the wall/corner). This device setup is more cost effective, is fully mobile in nature, and allows the weight room to accommodate and train more athletes than the typical jammer or strength machine. Principally, the rotating connection exercise apparatus as described, allows the user to strength train in any indoor or outdoor space, effectively and efficiently, due to the fully dynamic nature of the bar positioned in the apparatus' pivot, and the ability of the apparatus to detach and connect to a variety of fixtures.

Figure 1:
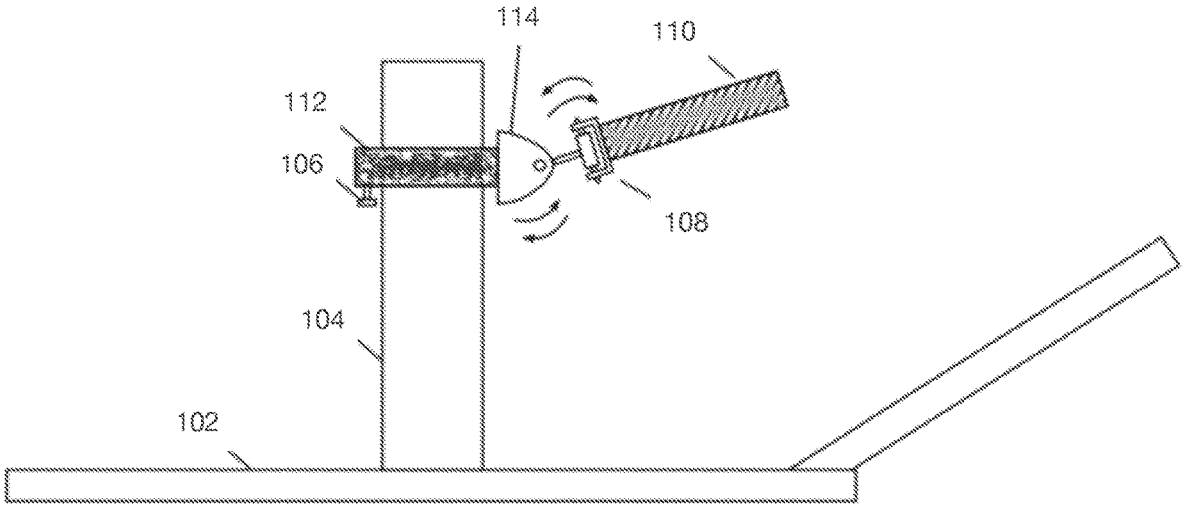
FIG. 1 illustrates various embodiments of the current apparatus.

FIG. 1 illustrates various embodiments of the current apparatus 100. This implementation contains a sleeve 112 that slides over any vertical or horizontal post 104, converting that post into a device that is able to receive a bar or tube (e.g., a 45 lb. weightlifting bar, or a post 104 connected to a landmine 102). Two hinge component 108 and 114 are present on the current apparatus allowing for full motion of a handle 110. Once connected, the apparatus rotates and moves fully within a 180 degree manner only limited by range of motion of the implement itself. A locking mechanism 106 is present to lock the apparatus at a particular location on the bar 104. When the locking mechanism 106, such as a screw clamp is not clamped down, the handle 110 is able to rotate a full 360 degree on the vertical or horizontal post 104 allowing weightlifting exercises such as but not limited to pressing the bar, squatting with the bar, rotating with the bar, curling the bar, or other similar exercises.

Figure 2:
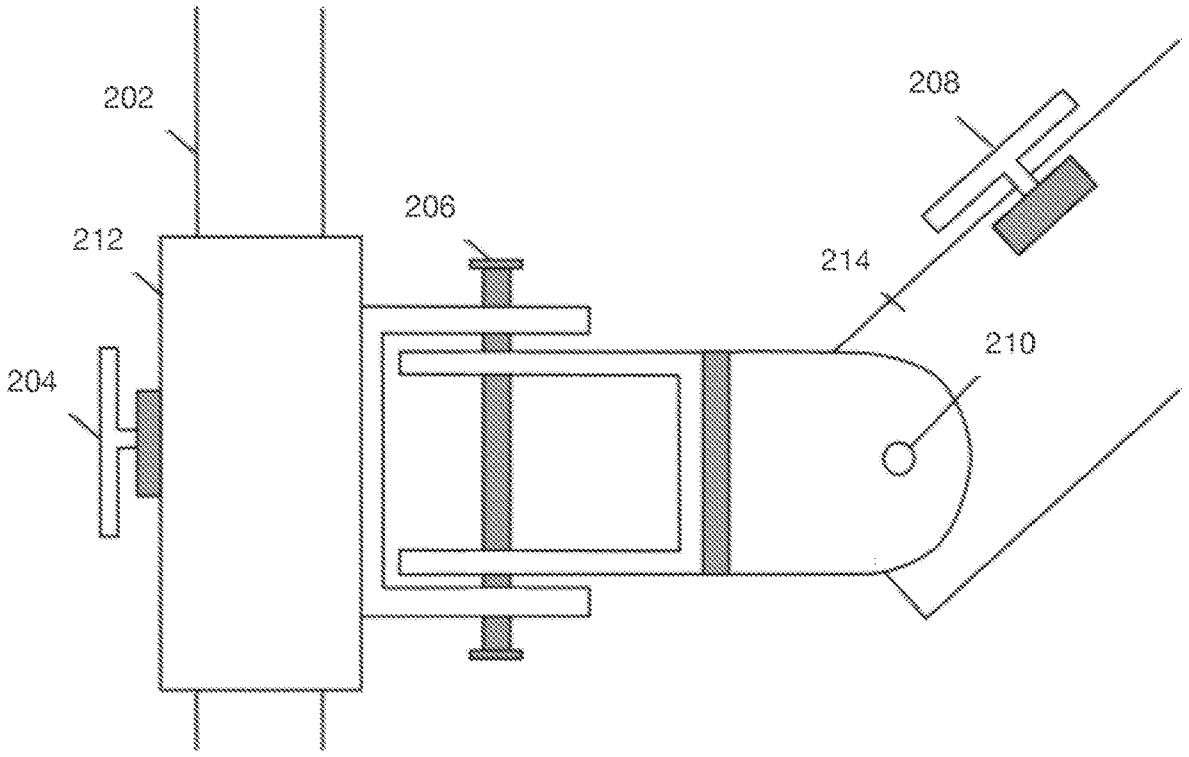
FIG. 2 illustrates a close-up view of the current apparatus.

FIG. 2 illustrates a close-up view of the current apparatus 200. The bar/post, or cylindrical projection 202 may be any vertical or horizontally positioned bar/post, or cylindrical projection that accepts standard weight plates (around 1.90 in circumference) such as a sled with vertical posts and/or a standard weight holder (commonly referred to as a "tree") with horizontal posts. The current apparatus 212 is slid onto the bar or post 202 and may be tightened at any point on the bar 202 by a locking mechanism 204. This locking mechanism 204 is tightened wherein a steel bar inside the locking mechanism is pushed onto the bar 202 to tighten the current apparatus 212.

In one implementation, there exists two hinges 206 and 210 on the current apparatus. One or both hinges may be removable such that a pin exists that may be removed (not depicted) or locked into place or may be immovable such as depicted in 206 and 210.

In yet another implementation, a locking pin 208 may be present to lock bars that are slipped into the handle 214.

In another embodiment, the current apparatus contains a sleeve (212) which can attach to a post 202 by the use of a hinge clamp such as a barbell or spring clamp or attached by a clamp with a strap that tightens or loosens the clamp.

The current apparatus turns any vertical or horizontal post 904 into a cylindrical sleeve that receives a tube or bar, such as a weightlifting bar, and rotates in 180 degrees in all movement planes 908 to perform weightlifting exercise such as the ones mentioned above. The advantage to this device is the mobility and manner in which it installs onto any sled that has a vertical or horizontal cylindrical projection or post that a user already owns. Users are able to use their existing exercise sled with a vertical plate loading post to do 'landmine' exercises.

In another embodiment, the locking mechanism consists of a button head screw that is installed from the inside of the receiver tube with a handle welded that will clamp the bar or tube rendering it Immovable from the receiver tube during use 1204.

Figure 3:
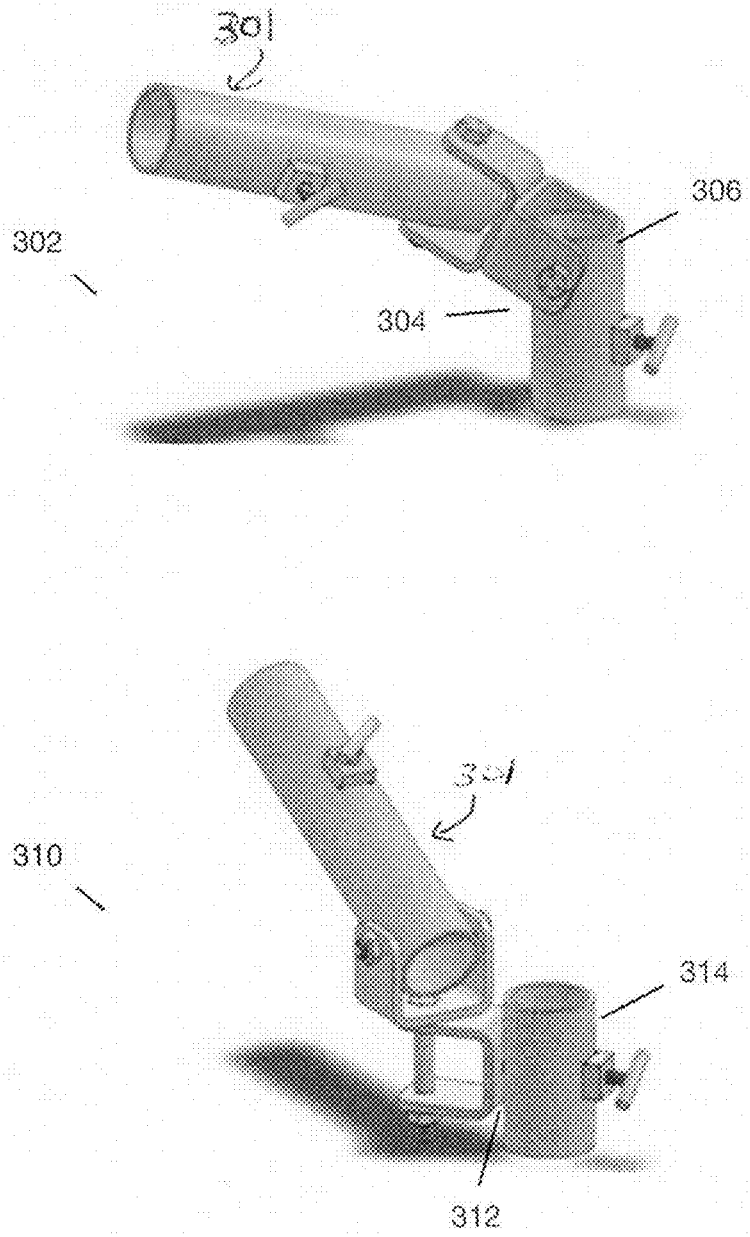
FIG. 3 illustrates alternate embodiments of the current apparatus.

FIG. 3 illustrates alternate embodiments of the current apparatus 300. The top diagram 302 shows one method of connection where a second sleeve 306 is pivotally connected to a first sleeve 301 at a top portion 304 of the second sleeve 306. The lower diagram 310 shows another method of connection where the second sleeve 314 is pivotally connected to the first sleeve 301 at a middle portion 312 of the second sleeve 306.

Figure 4:
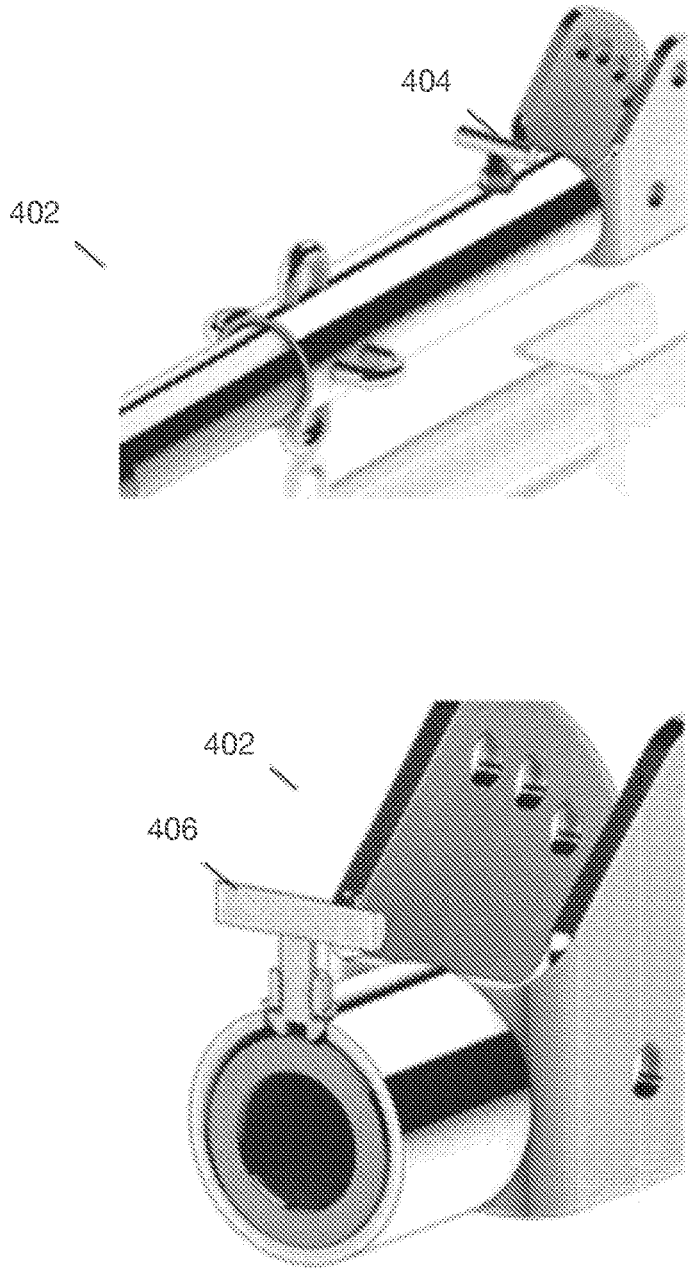
FIG. 4 illustrates yet further alternate embodiments of the current apparatus.

FIG. 4 illustrates yet further alternate embodiments of the current apparatus 400. The top FIG. 402 depicts the current apparatus with a locking mechanism 404 at the rear of the sleeve. The lower FIG. 402 depicts the apparatus sliced to show further detail. As can be seen in the diagram, the locking mechanism 406 is designed such that the mechanism may be turned, but not removed from the hole by the enlarging of the locking mechanism at the portion of the locking mechanism opposite the turning handle.

The locking mechanism (404/406) clamps down on the bar by assembling a button-head bolt from the inside of the tube and then welding a handle onto it preventing the device from moving on the bar or pole or ever coming out of the sleeve. This locking mechanism is novel due to the fact the screw cannot be removed from the device due to the button head bolt being assembled from the inside of the tube, as can be seen at 406. This device is installed by screwing it into the tube and assembling or welding a bolt, such as a button-head bolt, or any other flat piece of material to the screw from the inside of the tube. The bolt or other flat device is larger than the entrance of the screw which doesn't allow the screw to completely be removed but can be clamped down on a tube such as a weightlifting bar.

In another embodiment, the locking mechanism 404/406 is the same locking mechanism in the first apparatus 208. The advantage to this is the fact that a user cannot lose the locking clamp because it is unable to be removed from the mechanism and will hold any cylindrical projection that it is clamped onto.

Figure 5:
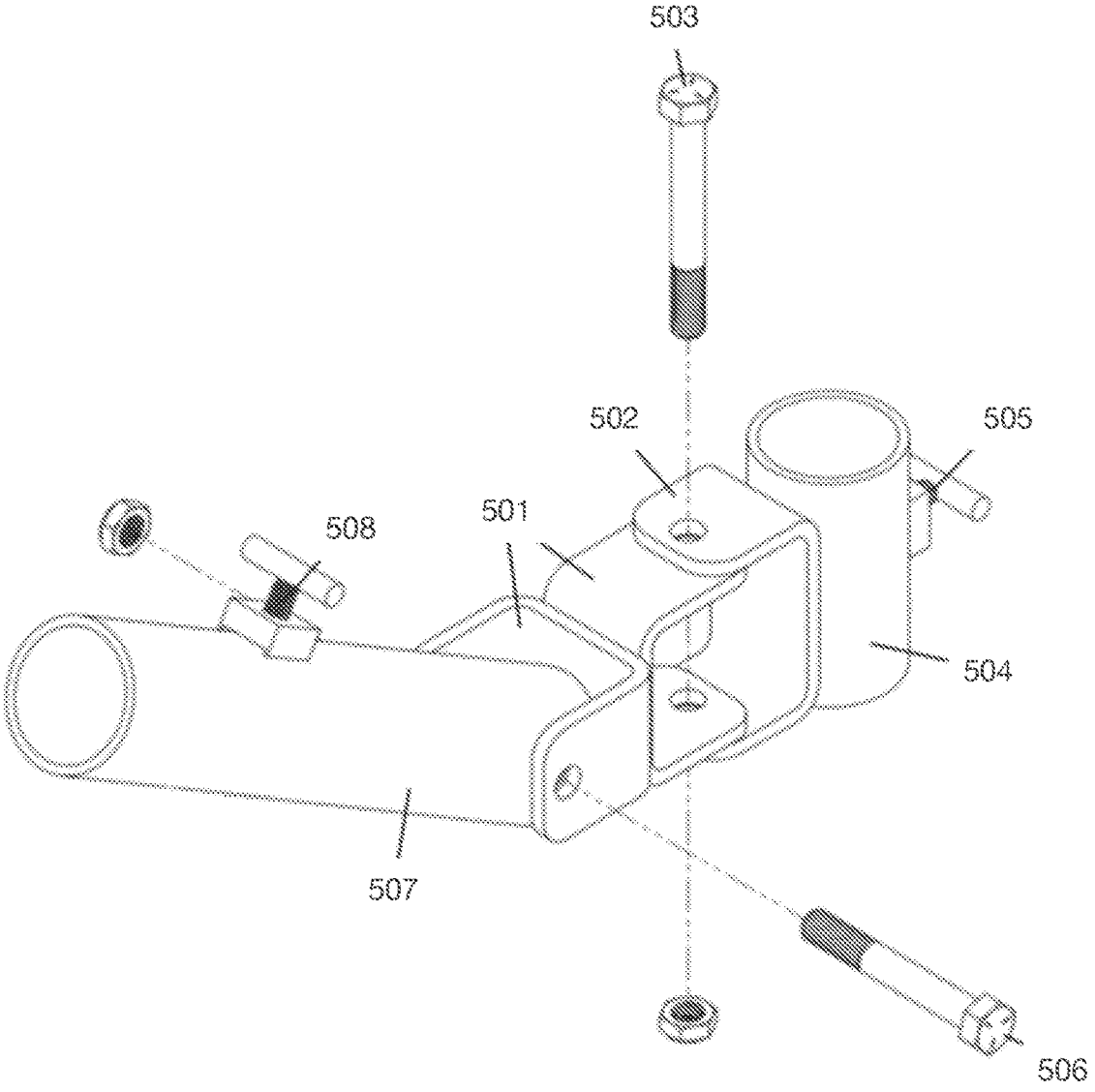
FIG. 5 illustrates a CAD diagram of another embodiment of the current apparatus.

FIG. 5 illustrates a CAD diagram yet another embodiment of the current apparatus 500. The apparatus 500 allows a bar or cylindrical projection such as a weightlifting bar to be slid into first sleeve 507 and secured with locking mechanism 508 or by the way of a hinge clamp that tightens around the bar. The apparatus has full range of motion due to first sleeve 507, pivot member 501, and vertically oriented first U-shaped member 502 being connected by pins/bolts 503 and 506. Connection point 503 can be a removable pin/bolt allowing 501 and 507 in its entirety to connect to various other apparatuses or points of connection such as but not limited to a trailer hitch attachment point for a vehicle, a wall mount, a sled mount, a weightlifting rack attachment, etc. A second sleeve 504 allows apparatus 500 to be positioned on any vertical or horizontal post such as a post that holds standard weightlifting plates. The second sleeve 504 is tightened around the post by the use of a screw clamp 505 (same as 204) or by means of a hinge clamp positioned on top or bottom of the second sleeve 504 that circumferentially tightens around the bar or post.

Figure 6:
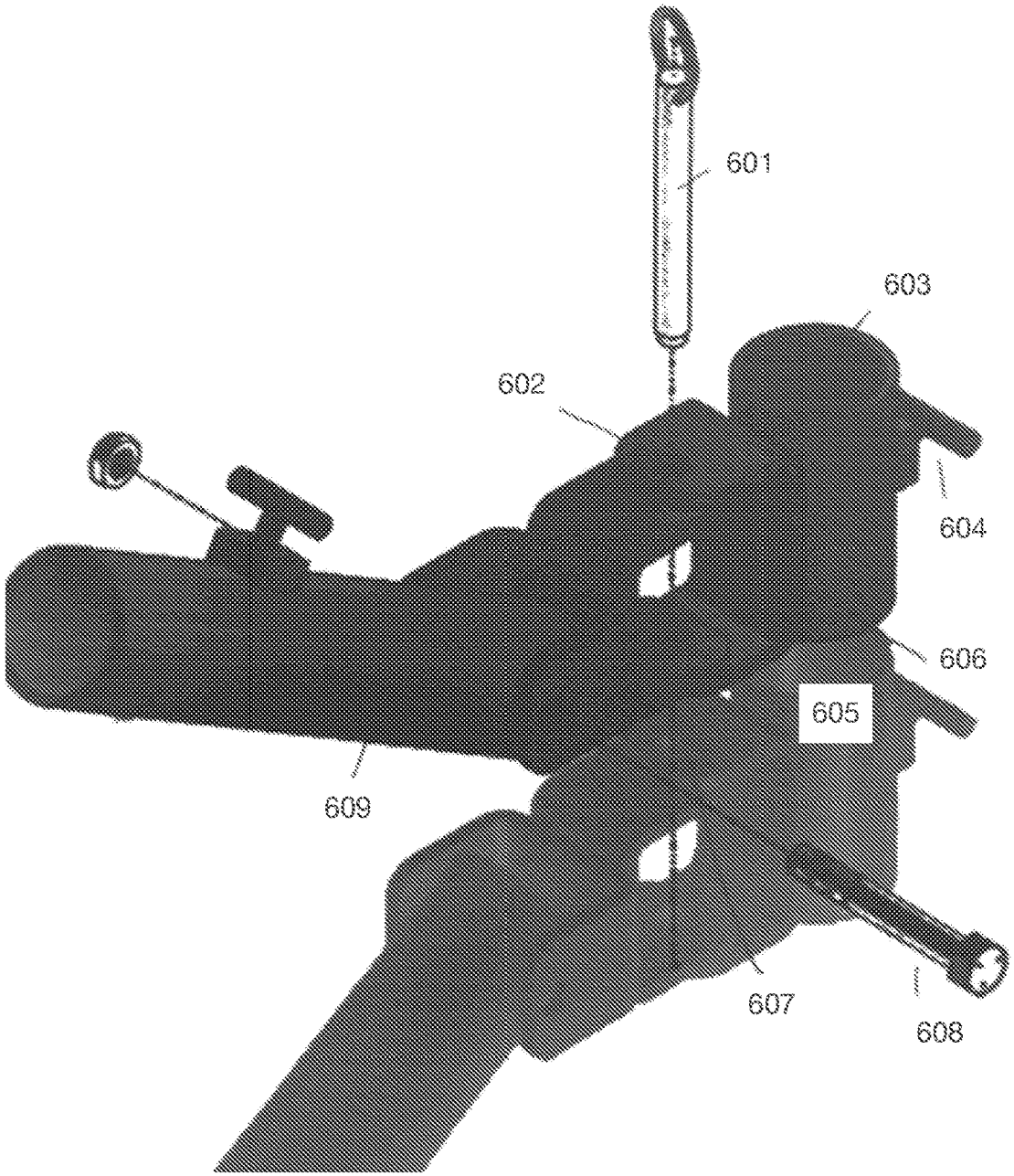
FIG. 6 illustrates a second CAD diagram of the current apparatus.

FIG. 6 illustrates the previously mentioned ability of the apparatus to be removable allowing connections to various other attachment pieces that hold the unit 600 stable during use. 601 is a removable pin that connects through holes 602 and 605 allowing a bar or other cylindrical object to be inserted into 609 for full range of motion with said bar or cylindrical object. 504/603 is just one of many attachments that can be used by the apparatus to keep the apparatus stationary allowing full range of motion with 609.

Figure 7:
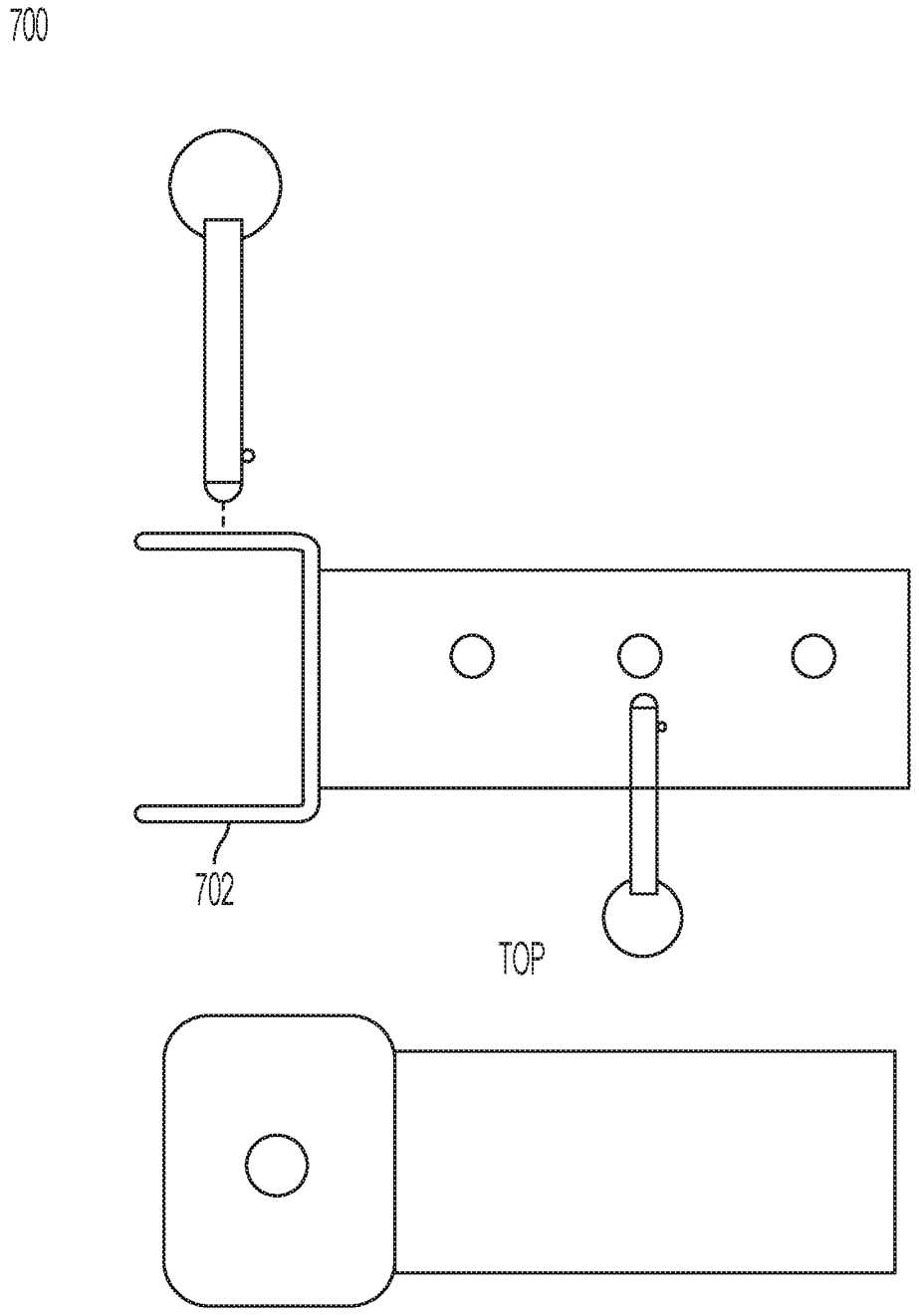
FIG. 7 illustrates a trailer hitch attachment.

FIG. 7 illustrates a trailer hitch attachment in another embodiment of the current apparatus 700. Another connection that can replace 504/603 is a trailer hitch attachment 700 (702 connects with 607).

Figure 8:
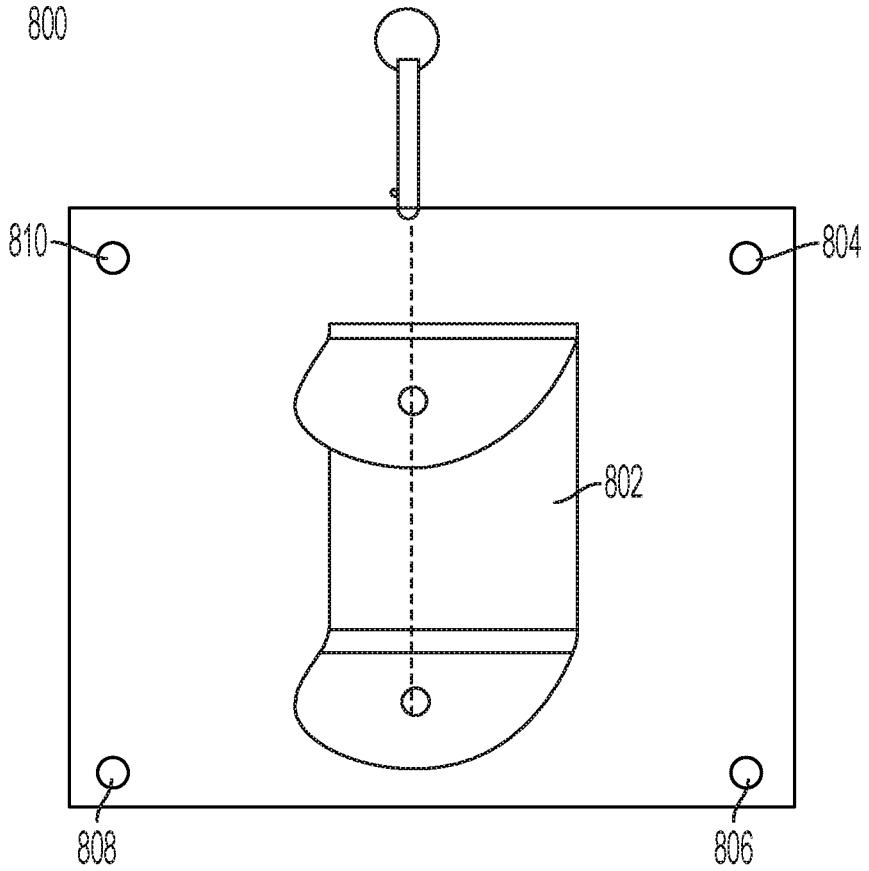
FIG. 8 illustrates wall mount attachment.

FIG. 8 illustrates a wall mount attachment in another embodiment of the current apparatus 800. The wall mount attachment has holes (804, 806, 808, 810 that allow for secure connection to another surface. The attachment 802 is a similar connection that allows for secure connection to 504/603.

Figure 9:
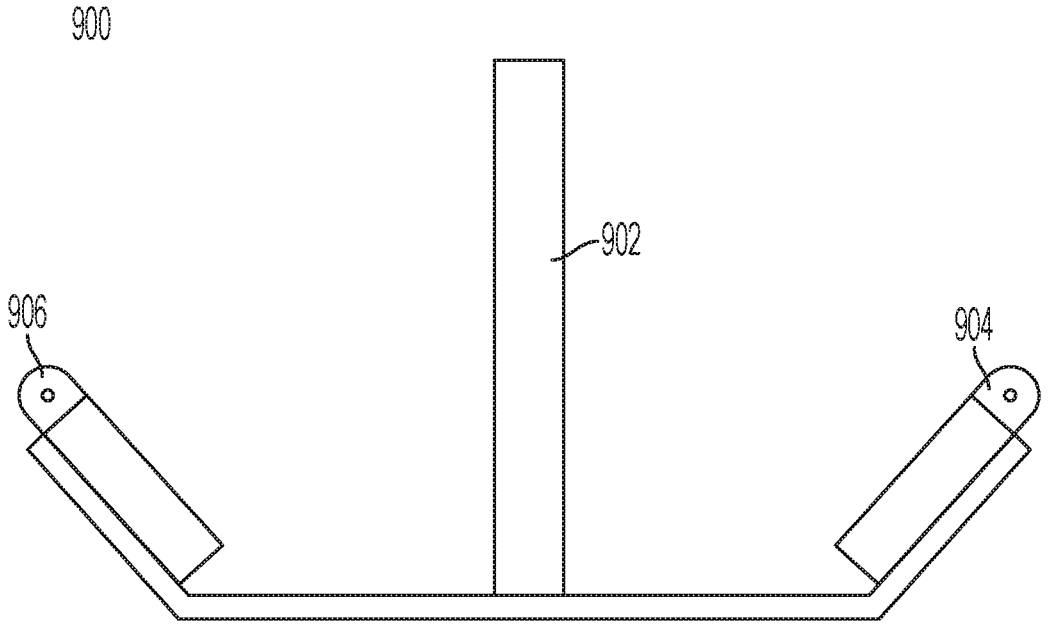
FIG. 9 illustrates a sled mount for a sled mine.

FIG. 9 illustrates yet another attachment in another embodiment of the current apparatus 900. The attachment is a sled mount for a sled mine apparatus. The apparatus has a vertical bar 902, allowing for normal sled mine connections, and has two connection points 906 and 904 that connect to 501/607 with a removable pin.

What is claimed is:

1. An apparatus for exercising using a barbell, the apparatus comprising:

a substantially cylindrical first sleeve having a first end and a second end, where the first end of the first sleeve is to receive a barbell;

a first locking mechanism in the first sleeve to secure the barbell in the first sleeve, the first locking mechanism including a head portion inside the first sleeve that prevents the first locking mechanism from being removed from the first sleeve;

a substantially cylindrical second sleeve to receive a mounting member, the second sleeve having a second locking mechanism;

a vertically oriented first U-shaped member mounted to the second sleeve; and a pivot member including a horizontally oriented second U-shaped member connected to a vertically oriented third U-shaped member, the second end of the first sleeve being removably connected to the horizontally oriented second U-shaped member to allow the first sleeve to rotate in a vertical direction, and the vertically oriented third U-shaped member being removably connected to the vertically oriented first U-shaped member to allow the first sleeve to rotate in a horizontal direction.

2. The apparatus of claim 1, wherein the first sleeve is configured to move between around 0 degrees and to around 180 degrees when connected to the second sleeve.

3. The apparatus of claim 1, wherein the first sleeve is configured to move between around 0 degrees to around 180 degrees when connected to the second end of the first sleeve.

4. The apparatus of claim 1, wherein the mounting member is oriented horizontally or vertically.

5. An apparatus for exercising using a barbell, the apparatus comprising:

a substantially cylindrical first sleeve having a first end and a second end, where the first end of the first sleeve is to receive a barbell;

a first locking mechanism in the first sleeve to secure the barbell in the first sleeve, the first locking mechanism including a head portion inside the first sleeve that prevents the first locking mechanism from being removed from the first sleeve;

a substantially cylindrical second sleeve to receive a mounting member, the second sleeve having a second locking mechanism;

a first U-shaped member pivotably attached to the second end of the first sleeve; and a second U-shaped member attached to the second sleeve, the second flange configured to be in a rotational relationship with the first U-shaped member.

6. The apparatus of claim 5, wherein the first sleeve is configured to move between around 0 degrees to around 180 degrees when connected to the second end of the first sleeve.

7. The apparatus of claim 5, wherein the second flange is pivotably attached to an end of the second sleeve.

8. The apparatus of claim 5, wherein the second flange is fixed in position with respect to the second sleeve.

9. The apparatus of claim 5, wherein the mounting member is oriented horizontally or vertically.

10. An apparatus for exercising using a barbell, the apparatus comprising:

a substantially cylindrical first sleeve having a first end and a second end, where the first end of the first sleeve is to receive a barbell;

a first locking mechanism in the first sleeve to secure the barbell in the first sleeve, the first locking mechanism non-removably attached to the first sleeve;

a substantially cylindrical second sleeve to receive a mounting member, the second sleeve having a second locking mechanism;

a vertically oriented first U-shaped member mounted to the second sleeve; and a pivot member including a horizontally oriented second U-shaped member connected to a vertically oriented third U-shaped member, the second end of the first sleeve being removably connected to the horizontally oriented second U-shaped member to allow the first sleeve to rotate in a vertical direction, and the vertically oriented third U-shaped member being removably connected to the vertically oriented first U-shaped member to allow the first sleeve to rotate in a horizontal direction.

11. The apparatus of claim 10, wherein the first sleeve is configured to move between around 0 degrees and to around 180 degrees when connected to the second sleeve.

12. The apparatus of claim 10, wherein the first end the first sleeve is configured to move between around 0 degrees to around 180 degrees when connected to the second end of the first sleeve.

13. The apparatus of claim 10, wherein the mounting member is oriented horizontally or vertically.

* * * * *